US008555833B2

(12) United States Patent
Astner et al.

(10) Patent No.: US 8,555,833 B2
(45) Date of Patent: Oct. 15, 2013

(54) VALVE CLEARANCE COMPENSATION DEVICE AND METHOD FOR CONTROLLING A VALVE CLEARANCE COMPENSATING DEVICE FOR AN INTERNAL COMBUSTION ENGINE

(75) Inventors: Josef Astner, Kernen (DE); Daniel Böhme, Kirchheim (DE); Marc Oliver Wagner, Esslingen (DE); Harry Wolf, Uhingen (DE)

(73) Assignee: Daimler AG, Stuttgart (DE)

( * ) Notice: Subject to any disclaimer, the term of this patent is extended or adjusted under 35 U.S.C. 154(b) by 356 days.

(21) Appl. No.: 12/924,988

(22) Filed: Oct. 8, 2010

(65) Prior Publication Data

US 2011/0056447 A1 Mar. 10, 2011

(30) Foreign Application Priority Data

Apr. 9, 2008 (DE) ..... 10 2008 017 948

(51) Int. Cl.
*F01L 9/02* (2006.01)
*F01L 1/14* (2006.01)

(52) U.S. Cl.
USPC ..... 123/90.12; 123/90.53; 123/90.55

(58) Field of Classification Search
USPC ..... 123/90.12, 90.52–90.59, 320–322
See application file for complete search history.

(56) References Cited

U.S. PATENT DOCUMENTS

| | | | | |
|---|---|---|---|---|
| 4,164,917 | A * | 8/1979 | Glasson | 123/321 |
| 5,379,737 | A * | 1/1995 | Hu | 123/322 |
| 5,645,031 | A * | 7/1997 | Meneely | 123/322 |
| 5,839,453 | A * | 11/1998 | Hu | 123/322 |
| 6,920,868 | B2 * | 7/2005 | Ruggiero et al. | 123/568.14 |
| 6,971,366 | B2 * | 12/2005 | Funke et al. | 123/321 |
| 7,325,522 | B2 * | 2/2008 | Schmidt | 123/90.27 |
| 7,845,327 | B2 * | 12/2010 | Tallio et al. | 123/90.52 |
| 7,900,597 | B2 * | 3/2011 | Meneely et al. | 123/323 |
| 8,225,769 | B2 * | 7/2012 | Dilly | 123/321 |
| 2004/0000276 | A1 * | 1/2004 | Borean et al. | 123/90.12 |

FOREIGN PATENT DOCUMENTS

| | | |
|---|---|---|
| DE | 43 34 517 | 4/1994 |
| DE | 10 2006 031 706 | 1/2008 |
| DE | 102006031706 A1 * | 1/2008 |
| JP | 59 099013 | 6/1984 |
| JP | 2006 170 010 | 6/2006 |
| RU | 171690 | 11/1964 |
| RU | 2 105 159 | 2/1998 |
| RU | 2 231 651 | 2/2004 |

* cited by examiner

*Primary Examiner* — Thomas Denion
*Assistant Examiner* — Steven D Shipe
(74) *Attorney, Agent, or Firm* — Klaus J. Bach

(57) ABSTRACT

In a clearance compensating device for an internal combustion engine with an internal part movably arranged within a guide duct of an external part for adjusting a clearance of an associated valve of the internal combustion engine, a pressure chamber, and a storage chamber which is hydraulically connected to the pressure chamber for receiving hydraulic fluid are associated with the interior part. Between the two chambers a one-way valve is disposed for applying an actuating force to the interior part relative to the external part. A feeding device is hydraulically connected to a blocking chamber for supplying a hydraulic fluid to the blocking chamber in order to exert a blocking force to the internal part acting in a direction opposite the actuating force under the control of a timing device the blocking force being modified depending on a cycle of the timing devices.

9 Claims, 1 Drawing Sheet

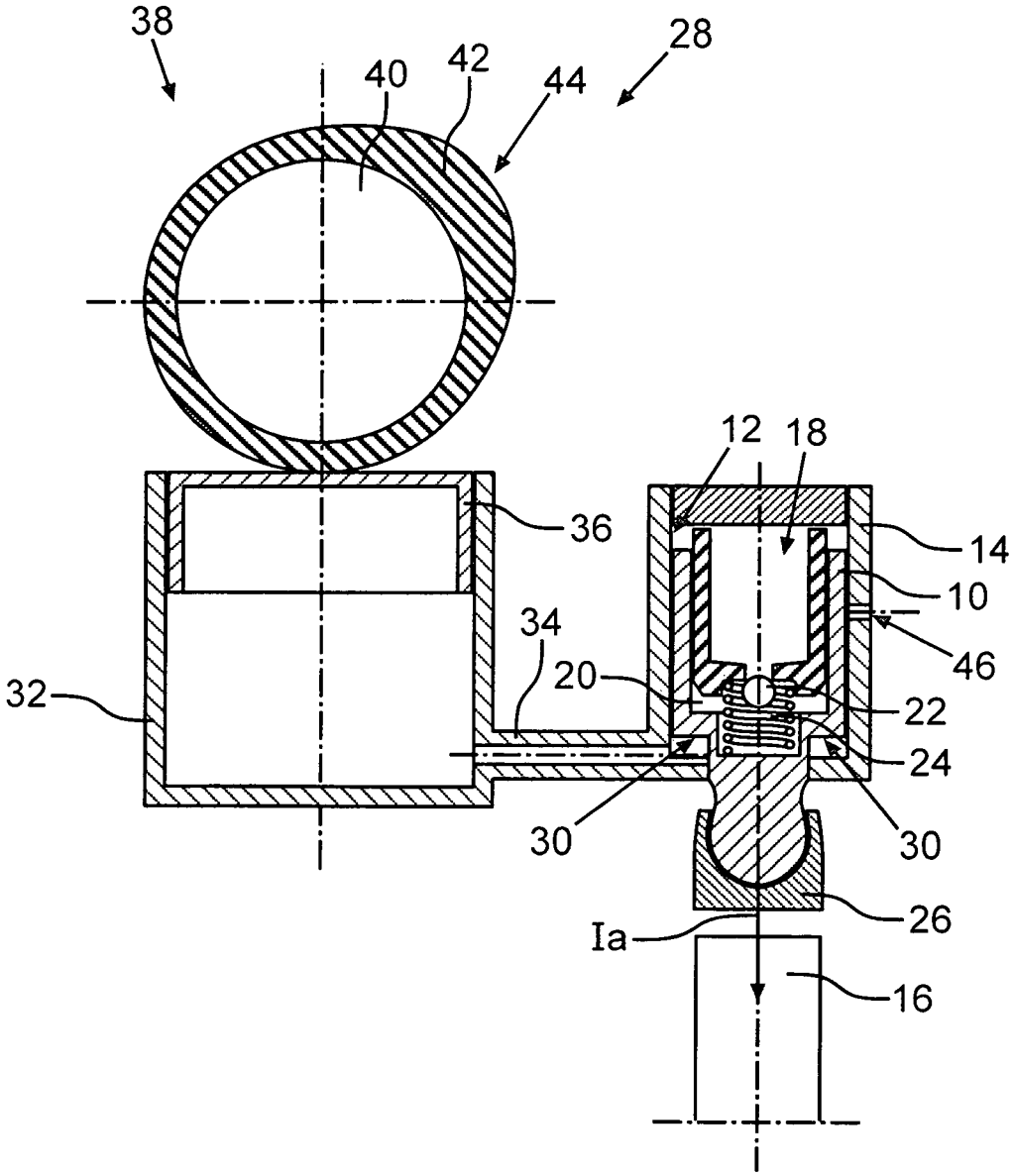
38
28
40
42
44
12
18
36
14
10
34
46
20
32
22
24
30
30
26
Ia
16

VALVE CLEARANCE COMPENSATION DEVICE AND METHOD FOR CONTROLLING A VALVE CLEARANCE COMPENSATING DEVICE FOR AN INTERNAL COMBUSTION ENGINE

This is a continuation in part application of pending international application PCT/EP2009/001651 filed Mar. 7, 2009 and claiming the priority of German Application 10 2008 017 948.5 filed Apr. 9, 2008.

BACKGROUND OF THE INVENTION

The invention relates to a valve clearance compensating device for an internal combustion engine and a method for controlling such a valve clearance compensating device.

Such a valve clearance compensating device is known for example from DE 10 2006 031 706 A1 and comprises an internal part, which is at least arranged over a longitudinal region within a guiding duct of an external part and can be moved along the guiding duct for clearance compensation of an associated valve of the internal combustion engine. The valve clearance compensating device further comprises a pressure chamber and a storage chamber hydraulically connected therewith for receiving hydraulic fluid, wherein the pressure and the storage chambers are in communication with the interior part via a one-way valve controlling the flow of the hydraulic fluid between the two chambers. The valve clearance compensating device further comprises a clearance compensating element, by means of which the interior part is applied with an actuating force with regard to the exterior part, and a feeding device, which is hydraulically connected to a blocking chamber and by means of which hydraulic fluid can be supplied to the blocking chamber for exerting a blocking force acting against the actuating force to the interior part. It is thus possible by means of the feeding device to inhibit movement, or to make a readjusting movement, of the interior part impossible.

It is the principal object of the present invention to create a valve clearance compensating device and a method for controlling such a valve clearance compensating device which permits a reliable and flexible inhibition of the adjusting function of the inner part.

SUMMARY OF THE INVENTION

In a clearance compensating device for an internal combustion engine with an internal part movably arranged within a guide duct of an external part for adjusting a clearance of an associated valve of the internal combustion engine, a pressure chamber, and a storage chamber which is hydraulically connected to the pressure chamber for receiving hydraulic fluid are associated with the interior part. Between the two chambers a one-way valve is disposed for applying an actuating force to the interior part relative to the external part. A feeding device is hydraulically connected to a blocking chamber for supplying a hydraulic fluid to the blocking chamber in order to exert a blocking force to the internal part acting in a direction opposite the actuating force under the control of a timing device the blocking force being modified depending on a cycle of the timing devices.

A valve clearance compensating device, which permits a reliable and flexible inhibiting of the readjusting function of the interior part is created according to the invention in that the feeding device comprises a timing device, wherein the blocking force can be modified in dependence on a cycle of the timing device. In other words, the valve clearance compensating device according to the invention makes a synchronized feed of hydraulic fluid into the blocking space possible and thereby permits reliable and flexible pressure build-up for exerting the blocking force acting against the actuating force on the internal part. It is ensured hereby that, in certain operating states of the internal combustion engine —for example during engine braking operation —the valve associated with the valve clearance compensating device can be opened by an exhaust gas counter pressure without the valve clearance compensating device compensating for the clearance. In this manner, it is prevented in a reliable manner that the valve remains continuously open, whereby an orderly gas exchange of the internal combustion engine would be impaired considerably. By means of a timing device for the feeding device it is possible in summary to control the amount of the hydraulic medium supplied to the blocking chamber in an intermittent manner and depending on the situation and to prevent an undesired readjusting of the interior part in a reliable manner.

In an advantageous embodiment of the invention it is thereby provided that the cycle of the timing design is adapted to an operating cycle of a cylinder of the internal combustion engine which is associated with the valve. The undesired readjusting of the interior part can hereby be inhibited in a particularly reliable and flexible manner, as the respective operating state of the internal combustion engine or of the cylinder can be considered in an optimum manner.

In a further advantageous embodiment of the invention it is provided that the feeding device comprises a pressure chamber for receiving the hydraulic fluid, wherein the pressure chamber of the feeding device has an adjustable volume change of the blocking force. Such a pressure chamber makes it possible to provide the amount of hydraulic fluid necessary for generating blocking forces with different force levels. By changing the volume of the pressure chamber, the hydraulic pressure necessary for representing the respectively desired blocking force can be adjusted in the blocking chamber in a particularly simple manner.

It has thereby further been shown to be advantageous that the timing device comprises a camshaft, by means of which the pressure chamber of the feeding device can be applied and its volume can be modified in dependence on a cam contour. This represents a constructively simple and reliable possibility to change the volume of the pressure chamber and thus the resulting blocking force in dependence on the desired actuating times of the blocking chamber in a synchronized manner. It can thereby be provided that a camshaft of the internal combustion engine which is present in any case, for example an output camshaft, is used as a timing device. Alternatively or additionally it can be provided that a camshaft which is present is provided with an additional cam or an additional cam contour, or that a camshaft associated with the feeding device is used.

Further advantages are obtained if the feeding device is coupled to a vehicle braking system that can be actuated hydraulically, in particular a decompression braking system. It is possible hereby to use the hydraulic fluid used for actuating the engine braking system advantageously for changing the blocking force. For this, the blocking chamber can for example be connected to an internal fluid channel of the engine braking system, for example a so-called Jake brake. The intermittent pressure build-up of the engine braking system is thereby adapted to the desired actuating times of the blocking chamber in an advantageous manner, so that an undesired readjusting of the interior part is prevented reliably depending on the lift curve of the associated valve.

It has thereby been shown to be advantageous in a further embodiment of the invention that the exterior part comprises a relieve opening, by means of which hydraulic fluid can be removed from the blocking chamber. The occurrence of excessive hydraulic fluid pressures which might cause damage to the valve clearance compensating device can hereby be prevented in a reliable manner.

A further aspect of the invention relates to a method for controlling a valve clearance compensating device according to one of the preceding embodiments, where hydraulic fluid is supplied to the blocking chamber by means of the feeding device for exerting a blocking force acting against the adjustment force on the interior part, wherein the blocking force is controlled depending on an operating cycle of the timing device of the feeding device. In this manner, a synchronized feeding of the blocking chamber with hydraulic fluid is obtained, which can be adapted to the respective operating state of the internal combustion engine in a flexible manner, whereby an undesired readjusting of the interior part can be prevented in a reliable manner.

In this connection, it has further been shown to be advantageous that the cycle of the timing device is adapted to the cycle of the cylinder of the internal combustion engine associated with the valve. This represents a particularly simple possibility to prevent the readjusting of the interior part in operating states of the internal combustion engine, in which the valve is opened by the exhaust gas counter pressure, but to enable a readjusting of the interior part and thus a hydraulic clearance compensation in regions without valve lift.

In a further advantageous arrangement of the invention it is provided that the blocking force is adjusted to be smaller than the actuating force during a cycle of the cylinder, in which no lift of the valve is carried out and/or during a cycle of the cylinder, in which a lift of the cylinder is carried out, is adjusted the same and/or larger than the actuating force. It is ensured in this manner that the undesired readjusting of the interior part is omitted in a reliable manner and the valve is not held open.

Further advantages, characteristics and details of the invention will become apparent from the following description of a particular embodiment of the invention with reference to the accompanying drawing. The only FIGURE shows a schematic sectional view of a valve clearance compensating device according to one embodiment of the invention.

BRIEF DESCRIPTION OF THE DRAWINGS

The sole FIGURE shows a schematic sectional view of a valve clearance compensating device according to the invention.

DESCRIPTION OF A PARTICULAR EMBODIMENT

The FIGURE shows a schematic sectional view of a valve clearance compensating device. The valve clearance compensating device shown herein comprises an internal part 10, which is arranged within a guide duct 12 of an external part 14 and can be moved along the guide duct 12 for adjusting the clearance of an associated valve 16 of an internal combustion engine (not shown). The valve clearance compensating device further comprises a pressure chamber 18 and a storage chamber 20 connected thereto, wherein a one-way valve 22 for the directional control of the flow of the hydraulic fluid is arranged in the hydraulic connection between the two chambers. Additionally, a clearance compensating system 24 in the form of a spring is arranged within the storage space 20, by means of which the internal part 10 can be biased with a certain actuating force toward the external part 14. The internal part 10, which has a spherical end mounted in a socket 26, is biased by the actuating force for clearance compensation according to arrow la against the valve 16 which is in operative connection with the socket 26. The one-way valve 22 opens hereby, so that hydraulic fluid can flow from the pressure chamber 18 into the storage chamber 20. As the valve 16 can be opened by the resulting exhaust gas counter pressure in certain operating states of the internal combustion engine —for example during an engine braking operation —, this could lead to an undesired readjusting of the internal part 10, whereby the valve 16 would remain open continuously even in the remaining operating states. In order to avoid this in a reliable manner, the valve clearance compensating device additionally comprises a supply device 28, which is hydraulically connected to a blocking chamber 30 and by which hydraulic fluid can be supplied to the blocking chamber 30 for exerting a blocking force on the internal part 10 acting against an actuating force. The supply device 28 has a pressure chamber 32 for this purpose for receiving the hydraulic fluid, which is connected hydraulically to the blocking chamber 30 via a fluid line 34. The pressure chamber 32 comprises a movable piston 36, by which a volume of the pressure chamber 32 can be adjusted. A pressure of the hydraulic fluid in the blocking chamber 30 and thus the magnitude of the blocking force acting against the actuating force can hereby be adjusted in a flexible manner and depending on the particular situation. In order to be able to adjust the blocking force in a definite and precise manner, the supply device has a timer 38, by means of which the blocking force can be changed in dependence on a cycle of the timer 38. The timing device 38 comprises a camshaft 40 on its part, by means of which the piston 36 can be actuated for changing the volume of the pressure chamber 32 and thus for changing the magnitude of the blocking force. The camshaft 40 has a cam 42 with a cam contour 44 for this purpose, which is in contact with the piston 36. In this manner, an intermittent pressure flow depending on the speed of the camshaft 40 can be generated, so that on one hand the extension of the internal part 10 is prevented in certain operating states of the internal combustion engine and, on the other hand, in operating states without lift of the valve 16, a readjusting of the internal part 10 and thus an automatic clearance compensation is still possible. A readjusting of the internal part 10 is in other words always possible if the generated blocking force is smaller than the actuating force of the valve clearance compensating element 24. A readjusting of the internal part according to arrow la is prevented, in contrast, if the blocking force is adjusted to be the same as, or preferably larger than, the actuating force. Alternatively or additionally, it can also be provided that, instead of the synchronized control by means of the shown supply device 38, the blocking chamber 30 is hydraulically connected to a fluid channel of an engine braking system (not shown), for example a so-called Jake brake. The intermittent, synchronized pressure build-up of the feeding device 28 formed hereby as part of the engine braking system is in this case also adapted advantageously to the desired actuation times of the blocking chamber 30.

The sliding surfaces between the internal part 10 and the external part 14 are lubricated by a leakage of hydraulic medium from the blocking chamber 30 which is released via a relief opening 46 in the external part 14.

What is claimed is:

1. A valve clearance compensating device for a valve (16) of an internal combustion engine, comprising:

an external part (14) having a guide duct (12), an internal part (10) which is arranged slidably within the guide duct (12) of the external part (14) at least along a longitudinal section of the guide duct (12) and is movable along the guide duct (12) in order to provide for the clearance of an associated valve (16) of the internal combustion engine, the clearance compensating device further including a pressure chamber (18), and a storage chamber (20) which are hydraulically interconnected with a one-way valve (22) disposed therebetween and which are associated with the internal part (10), a clearance compensating element (24), by means of which an actuating force can be applied to the internal part (10) for valve lash adjustment, and a supply device (28), which is hydraulically connected to a blocking chamber (30) and by means of which hydraulic fluid can be supplied to the blocking chamber (30) for exerting a blocking force against the actuating force to the internal part (10), the supply device (28) comprising a timing device (38) for modifying the blocking force in dependence on a cycle of the timing device (38) so as to prevent lash adjustment when the valve (16) is opened by the exhaust gas counter pressure in an exhaust pipe.

2. The valve clearance compensating device according to claim 1, wherein the cycle of the timing device (38) is adapted to a cycle of a cylinder of the internal combustion engine associated with the valve (16).

3. The valve clearance compensating device according to claim 1, wherein the supply device (28) comprises a pressure chamber (32) for receiving the hydraulic fluid, the pressure chamber (32) having an adjustable volume for modifying the blocking force.

4. The valve clearance compensating device according to claim 3, wherein the timing device (38) comprises a camshaft (40), by means of which pressure can be applied to the chamber (32) of the supply device (28) and its volume can be modified in dependence on a cam contour (44) of the camshaft (40).

5. The valve clearance compensating device according to claim 1, wherein the supply device (28) can be hydraulically coupled to an hydraulically operated engine braking system, in particular a decompression braking system.

6. The valve clearance compensating device according to claim 1, wherein the external part (14) comprises a relieve opening (46) by means of which hydraulic medium can be removed from the blocking chamber (30).

7. A method for controlling a valve clearance compensating device for a valve (16) of an internal combustion engine, comprising:

an external part (14) having a guide duct (12), an internal part (10) which is arranged slidably within the guide duct (12) of the external part (14) at least along one longitudinal section of the guide duct (12) and is movable along the guide duct (12) in order to provide for the clearance of an associated valve (16) of the internal combustion engine, the clearance compensating device further including a pressure chamber (18), and a storage chamber (20) which are hydraulically interconnected with a one-way valve (22) disposed therebetween and which are associated with the internal part (10), a clearance compensating element (24), by means of which an actuating force can be applied to the internal part (10) for valve lash adjustment, and a supply device (28), which is hydraulically connected to a blocking chamber (30) and by means of which hydraulic fluid can be supplied to the blocking chamber (30) for exerting a blocking force against the actuating force to the internal part (10), the supply device (28) comprising a timing device (38) for modifying the blocking force in dependence on a cycle of the timing device (38), said method comprising the steps of supplying a hydraulic medium to the interior part for exerting a the blocking force opposed to the actuating force and modifying the volume of the blocking chamber (30) in dependence on a cycle of the timing device (38) of the supply device (28) so as to prevent lash adjustment when the valve (16) is opened by the exhaust gas counter pressure in an exhaust pipe.

8. The method according to claim 7, wherein the cycle of the timing device (38) is adapted to a cycle of the cylinder of the internal combustion engine associated with the valve.

9. The method according to claim 8, wherein the blocking force is adjusted to be smaller than the actuating force during a cycle of the cylinder, in which no lift of the valve (16) is carried out, and the blocking force is at least equal to the actuating force present during a cycle of the cylinder, in which a lift of the valve is carried out.

* * * * *